United States Patent [19]

Asanae et al.

[11] Patent Number: 4,912,003

[45] Date of Patent: Mar. 27, 1990

[54] REVERSE DEVELOPMENT METHOD

[75] Inventors: Masumi Asanae, Kumagaya; Fumio Kimura, Isezaki, both of Japan

[73] Assignee: Hitachi Metals, Ltd., Tokyo, Japan

[21] Appl. No.: 235,122

[22] Filed: Aug. 23, 1988

[30] Foreign Application Priority Data

Aug. 24, 1987 [JP] Japan ..... 62-209566

[51] Int. Cl.[4] ..... G03G 13/09

[52] U.S. Cl. ..... 430/100; 430/106.6; 430/110; 430/122; 430/903

[58] Field of Search ..... 430/100, 106.6, 110, 430/903, 122

[56] References Cited

U.S. PATENT DOCUMENTS 4,288,515 9/1981 Yamashita et al. ..... 430/100
4,357,406 11/1982 Kouchi et al. ..... 430/903 X
4,376,813 3/1983 Yuge et al. ..... 430/100
4,401,741 8/1983 Miyakawa et al. ..... 430/106.6 X
4,436,802 3/1984 Ohtsuka et al. ..... 430/100

*Primary Examiner*—Roland E. Martin
*Attorney, Agent, or Firm*—Finnegan, Henderson Farabow, Garrett & Dunner

[57] ABSTRACT

A reverse development method comprising the steps of forming electrostatic image on the surface of an image-bearing member; supplying a developer comprising chargeable magnetic toner based on magnetic powder and a resin development roll comprising a conductive core, a permanent magnet arranged around the conductive core and a dielectric layer provided around and fixed to the permanent magnet and having conductive particles mutually insulated from each other; conveying the developer onto a surface of the image-bearing member by rotation of the developement roll so that the magnetic toner is attracted to the uncharged portions of the image; characterized in that the chargeable magnetic toner contains an aliphatic acid metal salt and is coated with hydrophobic silica.

3 Claims, 1 Drawing Sheet

REVERSE DEVELOPMENT METHOD

BACKGROUND OF THE INVENTION

The present invention relates to a reverse development method for providing reverse toner images by causing one-component magnetic toners to be attracted to the uncharged areas of a latent electrostatic image formed on an image-bearing member surface, and more particularly to a reverse development method capable of providing an improved image quality by improving the fluidity conveyability of magnetic toners.

Encouraged by wide use of computers in recent years, developments have been made actively on printer as peripheral equipment for producing hard copies as the outputs of information in the form of letters and figures. The printers which were most commonly used conventionally are so-called impact-type printers which produce prints by physically impinging selected printing types upon papers via ink ribbons. However, the appearance of higher-performance computers and the diversification of information to be processed have necessitated the quick processing of large amounts of information and various types of output forms such as various sizes of letters such as Chinese characters and figures. These requirements cannot be met by the conventional impact-type printers, so efforts have been made to develop new nonimpact-type printers (electronic printers).

The nonimpact-type printers ar classified into three groups; an electrophotographic type, an electrostatic type and an ink jet type rom the viewpoint of recording methods. In order to cope with the recent trends of increase in recording speeds and densities, the electrophotographic type appears to be the most promising.

The principles of recording by electrophotographic printers are essentially the same as those of usual copiers: The recording process comprises the steps of uniformly charging a photosensitive member surface, forming a latent electrostatic image by exposure, developing the latent electrostatic image with a toner, transferring the toner image onto a plain paper and fixing. Since in the electrophotographic printer, information supplied from a computer is written on a uniformly charged photosensitive surface with a laser beam, etc., and toner is caused to attach to the written areas, namely the exposed areas of the surface, development should be done in reverse.

Dry developers for the reverse development are usually two component-type developers which consist of magnetic carriers and non-magnetic toners like those for copiers. Most printers now in use utilize such developers.

When the two component-type developers are used, the toners have enough electrostatic charges due to the tribo-electrification with the carriers so that they can produce exact development of the nonimage areas of the latent electrostatic image. Further, since the toners retain electrostatic charges after the development, the toner image can be electrostatically transferred onto a commonly available plain paper, resulting in high-quality print image. The use of the two component-type developers, however, requires means for keeping carrier-toner mixtures at constant mixing ratios to maintain the constant optical densities of the resulting images, resulting in larger and more complicated developing apparatuses. In addition, the mixing and stirring of the carriers with the toners for extended periods of time leads to the formation of toner layers on the carrier surfaces, deteriorating the triboelectric characteristics of the carriers, which requires the periodic replacement of the carriers.

To solve these problems, one component-type developers consisting only of magnetic toner particles as dry developing components for developing latent electrostatic images have been developed and put into practical use. In a reverse development method using the so-called magnetic toners, the toners are generally attracted to the nonimage areas by applying DC bias voltage of the same polarity as that of the latent electrostatic image to a conductive sleeve holding the magnetic toners charged with the same polarity as that of the electrostatic image. Also, to facilitate electrostatic transfer of the developed toner image to a copy sheet, it is general to use insulating magnetic toners having high electric resistivity.

On the other hand, to achieve good development not only of electrostatic images consisting of line images but also of those including picture images, a development roll provided with a large number of microelectrodes (float electrodes) electrically insulated from each other was proposed and put to practical use (Japanese Patent Laid-Open No. 57-114163).

A typical example of a development apparatus comprising this development roll is shown in FIG. 1. 1 denotes a drum for bearing an electrostatic image on its surface and rotating in the direction shown in by the arrow. 2 denotes a development apparatus comprising a toner container 3 and a development roll 4. The development roll 4 is arranged in opposite to the image-bearing drum 1. The development roll 4 is constituted by a conductive core 5, a permanent magnet 6 having 8 magnetic poles and mounted on the surface of the conductive core 5, and a dielectric layer 7 provided around and fixed to the magnet 6. The dielectric layer 7 is provided with microelectrodes or float electrodes (not shown) composed of conductive particles mutually insulated from each other. 8 denotes a blade in contact with the surface of the development roll 4 in its tangential direction. 9 denotes a bias voltage source, one terminal of which is connected with the conductive core 5 and the other with the ground. 10 denotes a magnetic toner contained in the toner container 3, which is attracted to the surface of the development roll 4 and conveyed to a development region near the image-bearing drum 1 by the rotation of the roll 4 in the direction shown by the arrow.

In the above reverse development system, a thin layer of the magnetic toner 10 is formed by the blade 8 in contact with the development roll 4. The blade 8 is generally made of rubbers or other elastic materials. Therefore, smooth contact between the development roll 4 and the blade 8 is not always achieved, causing troubles in conveying the magnetic toner 10. In addition, since the fluidity of the magnetic toner 10 decreases at high humidity, the conveyance of the magnetic toner 10 cannot be conducted smoothly, failing to supply a sufficient amount of the magnetic toner to the development region. Further, particularly when a large number of copies are produced, the image quality is sometimes extremely deteriorated.

OBJECT AND SUMMARY OF THE INVENTION an object of the present invention is, therefore, to provide a reverse development method which can provide good image qualities by improving the fluidity and conveyability of magnetic toners.

Intense research in view of the above object has revealed that the use of chargeable magnetic toners containing an aliphatic acid metal salt and coated with hydrophobic silica method can provide an image with high quality.

Thus, the reverse development method according to the present invention comprises the steps of forming electrostatic image on the surface of an image-bearing member: supplying a developer comprising chargeable magnetic toner based on magnetic powder and a resin to a development roll comprising a conductive ore, a permanent magnet arranged around the conductive core and a dielectric layer provided around the permanent magnet and having conductive particles electrically insulated from each other; conveying the developer onto surface of the image-bearing member by rotation of the development roll; and applying a bias voltage to the development roll so that the magnetic toner is attracted to the uncharged portion of the electrostatic image; characterized in that the chargeable magnetic toner contains an aliphatic acid metal salt and is coated with hydrophobic silica.

DETAILED DESCRIPTION OF THE INVENTION

Figure 1:
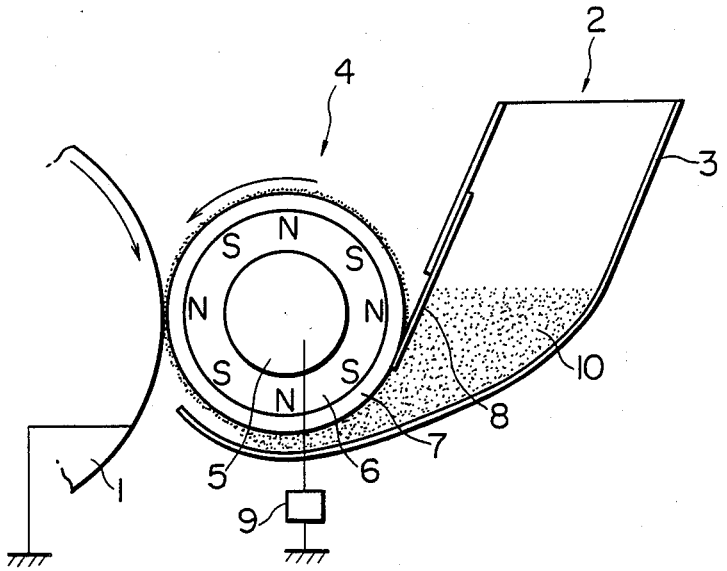
FIG. 1 is a cross-sectional view of a developing apparatus for conducting the method of the present invention.

The aliphatic acids constituting the aliphatic acid metal salts added to the magnetic toner according to the present invention include stearic acid, oleic acid, caproic acid, ricinoleic acid, etc., and they may be used alone or in combination. Metal salts of these aliphatic acids may be cadmium salts, barium salts, lead salts, iron salts, nickel salts, magnesium salts, strontium salts, zinc salts, calcium salts, etc., and they may be used alone or in combination. Among them, stearic acid metal salts, particularly calcium stearate and zinc stearate are preferable.

With respect to mixing of the aliphatic acid metal salt with the magnetic toner, it can be conducted in advance so that the magnetic toner mixed with the aliphatic acid metal salt is supplied into a toner container. However, the aliphatic acid metal salt can be mixed with the toner at the start of development in the toner container.

Incidentally, when the amount of the aliphatic acid metal salt added is less than 0.05 weight %, a lubricating action cannot be expected. On the other hand, when it exceeds 5 weight %, the fixability and developability of the resulting magnetic toner undesirably decrease.

The silica powder added to the magnetic toner should be hydrophobic, because if otherwise the magnetic toner would agglomerate and lose its resistivity at high humidity.

Magnetic powder which constitutes the magnetic toner may be made of alloys or compounds such as ferrite and magnetite composed of ferromagnetic elements such iron, cobalt and nickel, and various other alloys and compounds showing ferromagnetism by heat treatments or any other treatments. These ferromagnetic materials are contained in toner particles having particle sizes of several μm to several tens μm, so that they have preferably an average particle size of 0.02–3 μm. The amount of the magnetic powder contained in the toner is preferably 30–70 weight % based on the total weight of the toner. When it is less than 30 weight %, the toner does not have sufficient magnetism, resulting in the scattering of the toner particles from the development roll. On the other hand, when it exceeds 70 weight %, the toner shows reduced capability of fixing because of the insufficiently small amount of a resin binder. The preferred amount of the magnetic powder is 50–60 weight %.

Resin binders for the toner may be selected properly depending on fixing methods used. See, for instance, U.S. Pat. No. 4,433,442. For instance, when an oven heating method or a heat roll method is used for fixing, the following thermoplastic resins may be used. That is, homopolymers or copolymers of monomers such as styrene, vinyl esters of α-methylene aliphatic monocarboxylic acids, acrylonitrile, methacrylonitrile, acrylamide, vinyl ethers, vinyl ketones, N-vinyl compounds, etc. and their mixtures with the above vinyl resins may also be used.

Particularly for fixing by oven heating, bisphenol-type epoxy resins and bisphenol-type polyester resins are desirable, and for fixing by a heat roll styrene resins and polyester resins are desirable. As for the styrene resins, the more styrene components they have, the higher release characteristics they have to heat rolls. Further increase in the release characteristics to heat rolls can be achieved by adding low-molecular weight polyolefins, higher aliphatic acids having 28 or more carbon atoms, natural or synthetic paraffins, thermoplastic rubbers, etc.

On the other hand, when fixing is conducted by a pressure fixing method which applies only pressure at room temperature, pressure-sensitive resins such as higher aliphatic acids, higher aliphatic acid derivatives, higher aliphatic amides, waxes, rosin derivatives, alkyd resins, epoxy-modified phenol resins, natural resin-modified phenol resins, amino resins, silicone resins, polyurethanes, urea resins, polyester resins, oligomeric copolymers of acrylic acid or methacrylic acid with long-chain alkyl acrylate or long-chain alkyl methacrylate, oligomeric copolymers of styrene with long-chain alkyl acrylate or long-chain alkyl methacrylate, polyolefins, ethylene-vinyl acetate copolymers, ethylene-vinyl alkyl ether copolymers, maleic anhydride copolymers, petroleum resins and rubbers may be used.

These resins may be used alone or in any combination, but to ensure high fluidity when used for toners those having glass transition temperatures of more than 40° C. or their mixtures may be effectively used.

Apart from the above components, various pigments and/or dyes used for usual dry developers may be added. The amounts of such additives in total are preferably 3–10 weight % based on the total weight of the toner from the viewpoint of electric characteristics of the toner. The pigments or dyes which may be used include carbon black, aniline blue, calco oil blue, chrome yellow, Hansa yellow, Du Pont oil red, quinoline yellow, methylene blue chloride, phthalocyanine blue, malachite green oxalate, lamp black, rose bengale and their mixtures.

In addition to the above binder resin and colorant, the magnetic toner of the present invention may contain a charge controlling agent, a release agent, a flow improver, a filler, etc. The charge controlling agents which can be used include nigrosine dyes, reaction products of nigrosine dyes with carboxyl group-containing resins, triphenyl methane dyes, metal(Cr)-containing azo dyes, etc. The release agents which may be used include polypropylene, polyethylene, paraffin wax, carnauba wax, amide wax, etc. And the flow improvers may be hydrophobic silica. The fillers may be fine powders of calcium carbonate, talc, clay, etc.

The amounts of the above additives may be determined depending on the properties required to the magnetic toner. In general, the charge controlling agent is 0.1–5 weight %, the release agent 0.1–5 weight %, the flow improver 0.1–3 weight % and the filler 10 weight % or less.

The magnetic toner of the present invention may be prepared by known methods such a pulverization method and a spray drying method using the above materials. For instance, in the case of the pulverization method, the toner materials are subjected to dry premixing by a ball mill, a dry mixer, etc., blended while heating by a kneader, a roll, etc., cooled and solidified, and the solidified products are pulverized by a jet mill, etc. and classified. The resulting toner desirably has an average particle size of 8–11 μm. When the particle size is too small, the magnetic toner loses flowability, and when it is too large its resolution decreases and the effect of adding a stearic acid metal salt is lowered.

Further, it is desirable that the magnetic toner of the present invention has an electric resistivity of $10^{14}\Omega$.cm or more in a DC electric field of 4000 V/cm, and that it has a triboelectric charge of 2–20 μC/g as an absolute value when measured by a blow-off method. When its triboelectric charge is less than 2 μC/g, it produces much fogging, and when it exceeds 20 μC/g, the optical density of the resulting image decreases. The preferred triboelectric charge is between −14 μC/g and −20 μC/g in the case of a negative charge.

The magnetic toner of the present invention desirably has an apparent density of 0.50–0.75 g/cm$^3$ to achieve good reverse development. When the apparent density is too small, the toner has a small particle size, resulting in decrease in flowability. Further, the smaller the apparent density, the smaller the amount of magnetic powder contained in the toner, making it difficult to conduct good conveyance of the magnetic toner. On the other hand, when it has a too large apparent density, the toner size becomes too large, lowering the resolution. In this case, the amount of the magnetic powder is too large.

The reverse development method of the present invention is conducted with the above-described magnetic toner under the following conditions.

The conveyance speed of the magnetic toner ($V_T$) is desirably 0.8–1.5 times as large as the moving speed ($V_P$) of the image-bearing member. When $V_T > 1.5\ V_P$, too much toner is supplied to the development region, causing fogging easily. On the other hand, when $V_T < 0.8\ V_P$, too little toner is supplied to the development region, decreasing the development efficiency, which in turn decreases the optical density of the resulting image.

The developing gap between the image-bearing member and the development roll i desirably 5–200 μm. When it is smaller than 5 μm, the magnetic toner cannot pass therethrough without difficulty, and also it is likely to be deformed. On the other hand, when it exceeds 200 μm, contact between the toner and the image-bearing member becomes insufficient. That is, since the toner brush becomes too low relative to the magnetic gap, the toner cannot easily be attracted to the surface of the image-bearing member even with bias voltage, decreasing the optical density of the resulting image.

By resilient contact of a tip end of the blade with the surface of the development roll, a thin layer of the toner is formed on the roll surface. The thickness of the toner layer is desirably 5–20 μm. In this case, it is desirable tat the blade is pressed onto the roll surface under such pressure that the toner can pass between the blade and the roll surface in a mono layer.

In the present invention, the toner layer is desirably in slight contact with the surface of the image-bearing member. However, they may be separate from each other. Since toner particles pass through the development region in a connected state like a chain, the electrostatic image can be fully developed even with a gap between the toner layer and the image-bearing member to some extent.

Because of the existence of the aliphatic acid metal salt in the magnetic toner, contact between the magnetic toner and the blade can be achieved extremely smoothly. Without the aliphatic acid metal salt, white streaks appear in the resulting image-bearing member. However, the aliphatic acid metal salt contained in the toner makes it easier for the toner to pass between the the blade and the roll, avoiding the generation of white streaks.

In addition, the coating of the magnetic toner with hydrophobic silica serves to increase the flowability of the magnetic toner. Particularly when negative magnetic toner is used, the toner has an increased charge, leading to better development. Incidentally, when the magnetic toner mixed with the hydrophobic silica is mixed with the aliphatic acid metal salt at the start of development, the aliphatic acid metal salt continues to exist between the blade and the development roll. Thus, without supplying additional aliphatic acid metal salt to the magnetic toner, sufficient lubrication can be kept between the blade and the development roll.

The present invention will be explained in further detail by the following Examples without intention of restricting the scope of the present invention.

EXAMPLE 1

39 parts by weight of styrene-acrylic copolymer (SBM600 manufactured by Sanyo Chemical Co., Ltd.), 60 parts by weight of magnetite (EPT500 manufactured by Toda Kogyo Corp.), 1 part by weight of a charge controlling agent (BONTRON E81 manufactured by Orient Chemical Industries Ltd.) and 0.1–6, parts by weight, per 100 parts by weight of the toner, of calcium stearate were dry-mixed and blended at 200° C. by a kneader. The resulting blend was cooled and solidified and then pulverized by a jet mill to particles of 20 μm or less. The particles were charged into a super mixer and mixed with 0.5 part by weight of fine silica powder (R972 manufactured by Nippon Aerosil KK). The mixed powder was heat-treated in a hot air stream at 120° C. and then classified with the aid of an air flow by a zigzag classifier to provide a magnetic toner having an average particle size of 10 μm and a particle size distribution of 5–20 μm. This magnetic toner had an apparent density of 0.60 g/cm$^3$. It was observed that this magnetic toner had a resistivity of $10^{14}\Omega$.cm and a triboelectric charge of −12 μC/g.

Images were produced with this magnetic toner and evaluated under the following conditions. That is, an OPC photosensitive drum rotating at a peripheral speed of 60 mm/sec and having a surface potential of −620 V and a bias voltage of −400 V was used, and a development roll having symmetric 60 magnetic poles, a surface magnetic flux density of 110 G and an outer diameter of 25 mm was rotated at 55 rpm ($V_T$=72 mm/sec). A development gap was about 10 μm, and the thickness of the magnetic toner was controlled to be about 10 μm.

After developing with the above developing apparatus, the toner image was transferred to a plain paper at a transfer voltage of 5.5 kV, and fixed by a heat roll at 180° C. and 1.0 kg/cm.

The image quality was measured at the initial stage and at the time of producing 10,000 copies, respectively. The results are shown in Table 1.

TABLE 1

| No.* | Calcium Stearate (wt %) | Optical Density Start | Optical Density 10,000 Copies | Resolution Start | Resolution 10,000 Copies | Fixability |
|---|---|---|---|---|---|---|
| 1 | 0 | 1.37 | 0.72 | 6.3 | 4.0 | Excellent |
| 2 | 0.1 | 1.25 | 1.22 | 6.3 | 6.3 | Good |
| 3 | 0.5 | 1.22 | 1.23 | 6.3 | 6.3 | Good |
| 4 | 1.0 | 1.18 | 1.20 | 6.3 | 6.3 | Good |
| 5 | 1.0 | 1.27 | 1.14 | 6.3 | 6.3 | Good |
| 6 | 2.5 | 1.15 | 1.05 | 6.3 | 6.3 | Good |
| 7 | 2.5 | 1.22 | 1.07 | 5.6 | 5.6 | Good |
| 8 | 5.0 | 0.89 | 0.85 | 5.6 | 5.6 | Fair |
| 9 | 6.0 | 0.65 | 0.71 | 4.0 | 4.0 | Poor |

Note*: In Sample Nos. 1, 5 and 7, only the magnetic toner with the specified amount of calcium stearate was used at the start of development, and in the other Samples, 2 additional parts by weight of calcium stearate was added to 100 parts by weight of the magnetic toner at the start of development.

As is clear from Table 1, Sample No. 1 containing no calcium stearate shows high optical density and resolution at the initial stage of development, but both of them drastically decreases after continuously producing copies. On the other hand, among those containing calcium stearate at the start of development, Sample Nos. 2, 4 and 6 generally show slight low optical density at the initial stage, but substantial decrease in the optical density was not observed even after continuous production of copies. Further, in Sample Nos. 8 and 9 containing too large amounts of calcium stearate, their initial optical density was already low and their fixability was poor.

EXAMPLE 2

Example 1 was repeated except for using zinc stearate as a lubricant to produce various magnetic toners, and development was conducted in the same manner as in Example 1. The results are shown in Table 2.

TABLE 2

| No.* | Zinc Stearate (wt %) | Optical Density Start | Optical Density 10,000 Copies | Resolution Start | Resolution 10,000 Copies | Fixability |
|---|---|---|---|---|---|---|
| 1 | 0.7 | 1.42 | 1.15 | 6.3 | 5.6 | Good |
| 2 | 0.7 | 1.22 | 1.20 | 6.3 | 6.3 | Good |
| 3 | 2.0 | 1.35 | 1.28 | 6.3 | 6.3 | Good |
| 4 | 2.0 | 1.18 | 1.19 | 6.3 | 6.3 | Good |
| 5 | 4.0 | 1.21 | 1.07 | 6.3 | 6.3 | Good |
| 6 | 4.0 | 1.09 | 1.10 | 6.3 | 6.3 | Good |
| 7 | 8.0 | 1.11 | 0.63 | 5.6 | 4.0 | Poor |

TABLE 2-continued

| No.* | Zinc Stearate (wt %) | Optical Density Start | Optical Density 10,000 Copies | Resolution Start | Resolution 10,000 Copies | Fixability |
|---|---|---|---|---|---|---|
| 8 | 8.0 | 0.72 | 0.75 | 4.0 | 4.0 | Poor |

Note*: In Sample Nos. 1, 3, 5 and 7, only the magnetic toner with the dry-mixed calcium stearate was used at the start of development, and in the other Samples, 2 additional parts by weight of zinc stearate was added to 100 parts by weight of the magnetic toner at the start of development.

As is clear from Table 2, Sample Nos. 7 and 8 containing large amounts of zinc stearate produced images with low optical density and resolution. On the other hand, Sample Nos. 2, 4 and 6 containing zinc stearate at the start of development produced images with slightly low initial optical density, but their optical density was kept stable even after continuous copying.

In Examples, the amount of the aliphatic acid metal salt added to the magnetic toner at the start of development was 2 parts by weight per 100 parts by weight of the magnetic toner, but it should be noted that it may generally be 1–3 parts by weight.

As described above in detail, in the present invention, good lubrication can be achieved between a blade and a development roll, and the fluidity and conveyability of the magnetic toner to a development region can be drastically improved. Therefore, high image quality can be obtained.

The present invention has been explained by the Examples, but it should be noted that the present invention is not restricted thereto and that any modification can be made unless it deviates from the scope of the present invention defined by the claims attached hereto.

What is claimed is:

1. A reverse development method comprising the steps of:

forming an electrostatic image on the surface of an image-bearing member;

supplying a developer comprising chargeable magnetic toner based on magnetic powder and a resin to a development roll comprising a conductive core, a permanent magnet arranged around said conductive core and a dielectric layer provided around said permanent magnet and said dielectric layer having conductive particles mutually insulated from each other;

conveying said developer onto a surface of said image-bearing member by rotation of said development roll; and applying a bias voltage to said development roll so that said magnetic toner is attached to the undercharged portions of said image, characterized in that said chargeable magnetic toner contains 30–70 weight % of magnetic powder and 0.05–5 weight % of an aliphatic acid metal salt and is coated with hydrophobic silica; that a gap between said image-bearing member and said development roll is 5–200 μm; that a conveyance speed of said magnetic toner is 0.8–1.5 times the surface moving speed of said image-bearing member; and that a layer of said magnetic toner conveyed on said development roll has a thickness of 5–20 μm.

2. The reverse development method according to claim 1, wherein said aliphatic acid metal salt is mixed with said developer at the initiation of development.

3. The reverse development method according to claim 1, wherein said magnetic toner has an apparent density of 0.50–0.75 g/cm$^3$ and an average particle size of 8.0–11.0 μm.

* * * * *

UNITED STATES PATENT AND TRADEMARK OFFICE

CERTIFICATE OF CORRECTION

PATENT NO. : 4,912,003

DATED : March 27, 1990

INVENTOR(S) : MASUMI ASANAE

It is certified that error appears in the above-identified patent and that said Letters Patent is hereby corrected as shown below:

ON THE TITLE PAGE
In the Abstract, line 11:

Change "developement" to --development--;

After "roll" insert --; and applying a bias voltage to the development roll--.

Signed and Sealed this

Second Day of April, 1991

*Attest:*

HARRY F. MANBECK, JR.

*Attesting Officer*

*Commissioner of Patents and Trademarks*